US005513863A

United States Patent [19]

Klamer et al.

[11] Patent Number: 5,513,863

[45] Date of Patent: May 7, 1996

[54] INTEGRAL MULTI-FUNCTION ROLLER SKATE SYSTEM

[76] Inventors: Reuben B. Klamer, 14 Greenview Dr., Carlsbad, Calif. 92009; Pablo E. Pardo, 15 Linda St., San Francisco, Calif. 94110

[21] Appl. No.: 425,476

[22] Filed: Apr. 20, 1995

Related U.S. Application Data

[63] Continuation of Ser. No. 212,193, Mar. 11, 1994, Pat. No. 5,449,183.

[51] Int. Cl.[6] ..... A63C 17/04

[52] U.S. Cl. ..... 280/11.27

[58] Field of Search ..... 280/11.19, 11.22, 280/11.23, 11.27, 11.28, 87.041, 87.042; 301/128

[56] References Cited

U.S. PATENT DOCUMENTS

| | | | |
|---|---|---|---|
| 1,608,368 | 11/1926 | Bugg | 280/11.27 |
| 2,598,831 | 6/1952 | Ramey | 301/128 |
| 2,599,136 | 6/1952 | Sherman | 301/128 |
| 4,565,539 | 1/1986 | Cook | 446/462 |
| 4,603,868 | 8/1988 | Schütz | 280/7.13 |
| 5,366,232 | 11/1994 | Pozzobon et al. | 280/11.22 |
| 5,372,534 | 12/1994 | Levy et al. | 280/11.22 |
| 5,421,596 | 6/1995 | Lee | 280/11.27 |
| 5,441,286 | 8/1995 | Pozzobon | 280/11.27 |

*Primary Examiner*—Richard M. Camby
*Attorney, Agent, or Firm*—Snell & Wilmer

[57] ABSTRACT

A multi-function roller skate system functions as a conventional skate configuration, with the wheels wide apart, and also as an in-line skate configuration, with a single row of wheels. The skate has multiple pairs of wheels which may be moved closer together or farther apart according to the skater's needs, either in connection with training or to accommodate changing skating conditions. When the wheels are at their closest, each pair operates as a single wheel directly under the skater's foot like an in-line skate. The skate may include at least one intermediate position for intermediate skill skaters. In addition, the skate may be extended to fit different or growing skaters.

9 Claims, 10 Drawing Sheets

INTEGRAL MULTI-FUNCTION ROLLER SKATE SYSTEM

This is a continuation of Ser. No. 08/212,193 filed on 11 Mar. 1994 U.S. Pat. No. 5,449,183.

BACKGROUND OF THE INVENTION

1. Field of the Invention

The present invention relates to roller skates, and more particularly, to an integral multi-function arrangement that offers both a conventional roller skate and an in-line skate embodied within one system.

2. Description of the Related Art

Roller skating has been enjoyed for many generations, and the well known conventional roller skates generally have four wide wheels, with one pair of wheels in front and another pair in the rear. The wheels of each pair are set well apart so that the wheels are approximately aligned with or extend beyond the sides of the skater's foot, contributing stability to the skate.

Recently, there has been developed what is known as an in-line roller skate, which has been enjoying a surge of popularity. In-line roller skates usually have at least three narrow wheels aligned in a single row directly beneath the skater's foot. The in-line skate provides the skater with better turning capacity and agility, but the narrow wheel base makes in-line skates inherently more unstable and more difficult to master. As a result, young or inexperienced skaters are more susceptible to falling and possible injuries in developing skills required by in-line roller skating.

A further potential problem exists with respect to in-line roller skates. As even accomplished in-line roller skaters become older, they are likely to become much more concerned and apprehensive about falling. Moreover, and particularly for either older or inexperienced skaters, there are likely to be occasions where they are comfortable with in-line skating, such as when the risk of falling is small. This might be, for example, while skating on smooth, level surfaces in uncrowded conditions. On the other hand, such skaters might not be comfortable because the risk of falling and injury would be greater while skating on rough or inclined surfaces, or in crowded conditions.

In connection with young or inexperienced skaters who are just learning to skate, the difficulty of learning how to skate on in-line skates may also be discouraging. They may become frustrated and lose patience trying to master in-line skates and simply give up. Learning to skate on in-line skates may be simplified, however, if the skater is first familiar with skating on conventional skates. By first learning on conventional skates, the basic balance and movement skills may be grasped. Then the skater may move on to the more difficult in-line skates.

Although learning in stages is generally the most effective technique, it is commonly the most costly. Roller skates, including conventional and in-line skates, are often expensive. Consequently, the cost of two different sets of skates may deter many parents or skaters from purchasing both conventional and in-line skates, particularly if they are viewed simply as toys. This is especially true for small children that quickly grow out of items like roller skates. If the skater has only a pair of conventional roller skates, the skater is limited to learning only conventional roller skating, and cannot advance to the more difficult in-line skates. On the other hand, if the beginning skater has only in-line skates, the skater is forced to learn on the more difficult in-line skates. The obstacle may prove to be too much, causing the skater to become frustrated and give up in despair.

Furthermore, even an accomplished and experienced in-line skater may encounter conditions during the course of a skating "outing" where he or she is not comfortable on the in-line skates due to a greater risk of falling. In such a situation, the skater's only choices would be to take off the in-line skates and discontinue skating, or perhaps replace them with a pair of conventional roller skates which the skater had brought along for that purpose. The disadvantages and inconveniences of either approach are clear.

One manufacturer has addressed the problem of training inexperienced in-line skaters with a three-wheel in-line skate having a laterally adjustable middle wheel. In one configuration, all three wheels are aligned directly under the skater's foot in an in-line configuration. The middle wheel, however, may be moved laterally towards the outside of the skater's foot. This triangular configuration provides an inexperienced skater with a sort of training wheel to stabilize the skate. On the other hand, the laterally shifted wheel does not provide as much stability as a conventional roller skate configuration. In addition, if the skater prefers the conventional roller skate configuration, the skater must purchase an altogether new set of skates.

SUMMARY OF THE INVENTION

In accordance with one aspect of the present invention, an integral multi-function roller skate system is provided wherein the skate may function as either a conventional roller skate or as an in-line skate. The skate has at least one pair of wheels which, in the conventional configuration, are separated from each other so that the edges of the wheels coincide with or extend beyond the sides of the shoe. In the in-line configuration, the distance between the wheels is reduced so that the two wheels in each pair operate as a single wheel. The wheels are aligned directly under the skater's foot in the same position as an in-line skate.

In addition, according to another aspect of the present invention, the skate includes at least one intermediate position in which the wheels are closer together than conventional skates, but are not in the in-line configuration, either. Instead, the wheels are approximately midway between the conventional configuration and the in-line configuration to allow either gradual progress to the in-line configuration or provide enhanced stability to an in-line skate when difficult conditions are experienced during a roller skating "outing."

According to another aspect of the present invention, the roller skate is adjustable to fit different sizes of feet. The toe of the skate extends forward with, for example, the front two wheels. Thus, the skate can be fitted to various people or adjusted to fit the skater's foot as the skater grows. Of course, different size adjustment arrangements other than that disclosed herein can be used with the multi-function features of the present invention. Moreover, the multi-function system features can alternatively be used without any size adjustment features.

The integral multi-function skate of this invention permits the skater to learn both conventional roller skating and in-line skating. A novice skater may set the wheels as far apart as possible for maximum stability according to the conventional configuration. As the skater improves, the skater can adjust the wheels to a more challenging intermediate position between the conventional configuration and the in-line configuration. When the skater is ready, the wheels may then be adjusted to the in-line configuration. If the skater grows as he or she progresses, the skate may be easily adjusted to conform to the skater's larger foot size. Moreover, even with respect to accomplished in-line skaters, the integral skating system of the present invention permits configuring the skate to provide enhanced stability when difficult conditions are encountered or as otherwise might be desirable when the skater grows older.

BRIEF DESCRIPTION OF THE DRAWINGS

The preferred exemplary embodiment of the present invention is hereinafter described in conjunction with the appended drawings, wherein like designations denote like elements, and.

DETAILED DESCRIPTION OF THE PREFERRED EMBODIMENT

Referring now to FIGS. 1A–1E, a preferred exemplary embodiment of the bottom portion of a roller skate R according to the present invention is shown. The exemplary bottom portion of roller skate R comprises: a frame 100; two wheel supports 102A–B; six wheels 104A–F; and a mechanism 106 (not shown) for moving wheel supports 102A–B laterally across the bottom of frame 100. As described later, a mechanism (not shown) for fixing roller skate R to a skater's foot may be mounted on frame 100.

Frame 100 has a flat upper surface 108 for supporting the skater on skate R. The upper surface of frame 100 is wide enough and long enough to support the skater's foot, and is shaped to approximately conform to the shape of the skater's foot. The bottom of frame 100 is flat, where it is connected with wheel supports 102A–B and mechanism 106 for moving wheel supports 102A–B. To protect wheels 104A–F in the event of collision, the front and back of frame 100 may extend downward in front of and behind wheels 104A–F, respectively, in the form of relatively large and solid bumpers 110, 112. Frame 100 is suitably composed of a rigid plastic or metal which can withstand significant stress and impacts without failing.

The bottom of frame 100 suitably includes a substantially flat area between front and rear bumpers 110, 112, for the wheel support moving mechanism 106, as described below with respect to FIGS. 2A–2B. Both wheel supports 102A–B are suitably attached to the bottom of frame 100, in this exemplary embodiment by wheel support moving mechanism 106, so that the plane of each wheel support is perpendicular to the plane of the bottom of frame 100. In addition, wheel supports 102A–B suitably extend lengthwise parallel to the longitudinal axis of frame 100. Wheel supports 102A–B are attached rigidly to the bottom of frame 100 so that wheel supports 102A–B are prohibited from rotating under frame 100 and collapsing.

Figure 1A:
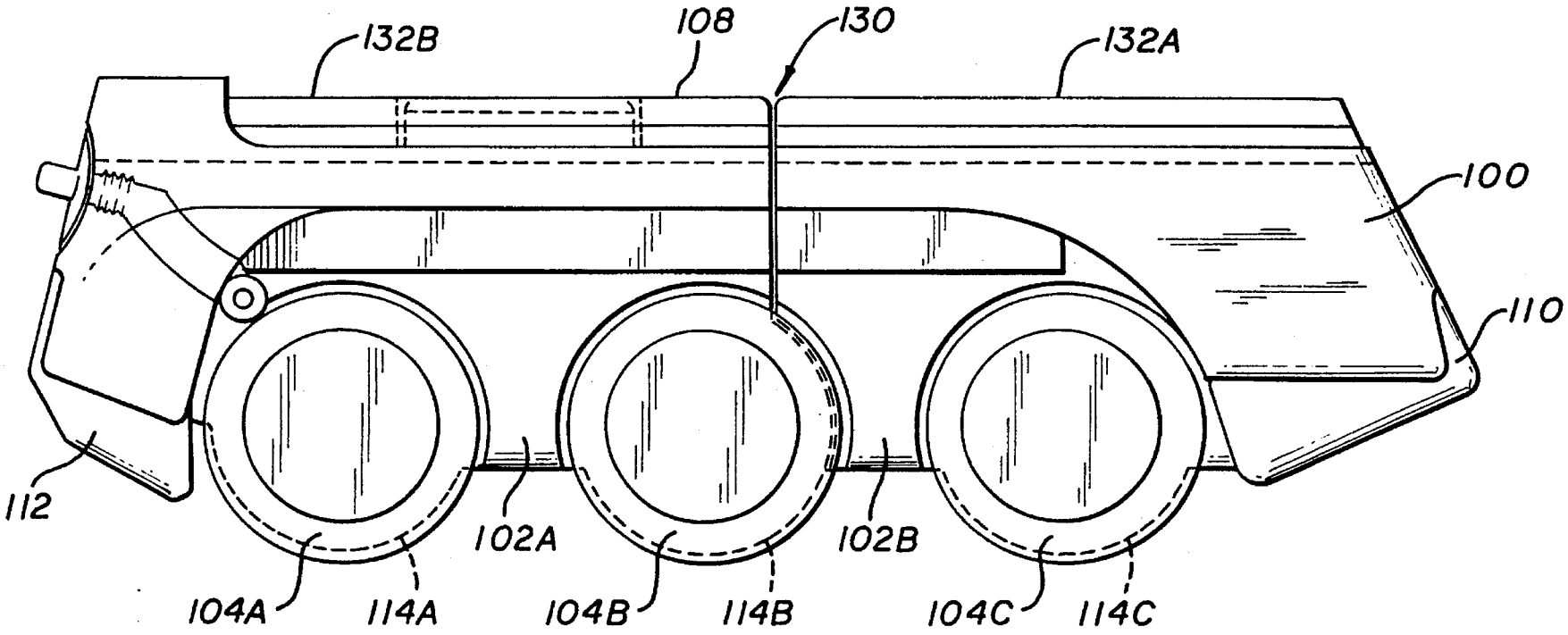
FIGS. 1A–1E illustrate the bottom portion of a roller skate according to the present invention from elevational (and partly cut away), top, and rear view, respectively.

Each wheel support is composed of a rigid plastic or metal or other suitable material that can withstand shock and stress without cracking or breaking. Each wheel support is also suitably shaped according to the shape of frame 100 to provide a functional and aesthetically appealing interaction between frame 100 and wheel supports 102A–B. In the exemplary embodiment, each wheel support 102A–B has a flat upper edge which smoothly abuts the bottom side of frame 100. Each wheel support 102A–B also suitably includes three semicircular projections 114A–F along its bottom edge on which wheels 104A–F are suitably mounted. In FIG. 1A, front wheel 104C has been removed and the front portion of wheel support 102A is cross-hatched to illustrate its construction.

Each wheel support suitably has three wheels attached to it. The number of wheels, of course, may vary from skate to skate, particularly when considerations of foot size and age of the skater are taken into account. Wheels 104A–F are suitably mounted rotatably on the semicircular projections 114A–C formed on the bottom edge of each wheel support 102A–B so that wheels 104A–F rotate in the same plane as wheel supports 102A–B. Any suitable mechanism, such as rivets or bolts, may be used as axles and to attach wheels 104A–F to wheel supports 102A–B and allow wheels 104A–F to rotate substantially freely. Wheels 104A–F are suitably mounted on wheel supports 102A–B so that each wheel 104A–C is opposed by a corresponding wheel 104D–F on the other wheel support, forming three pairs of wheels, as shown in FIGS. 2A–2B. Each wheel is suitably composed of a durable plastic or metal that can withstand substantial stress and impact without failing. For young skaters, wheels 104A–F may be equipped with brakes to slow down a skater that may lose control and roll too quickly.

Figure 1B:
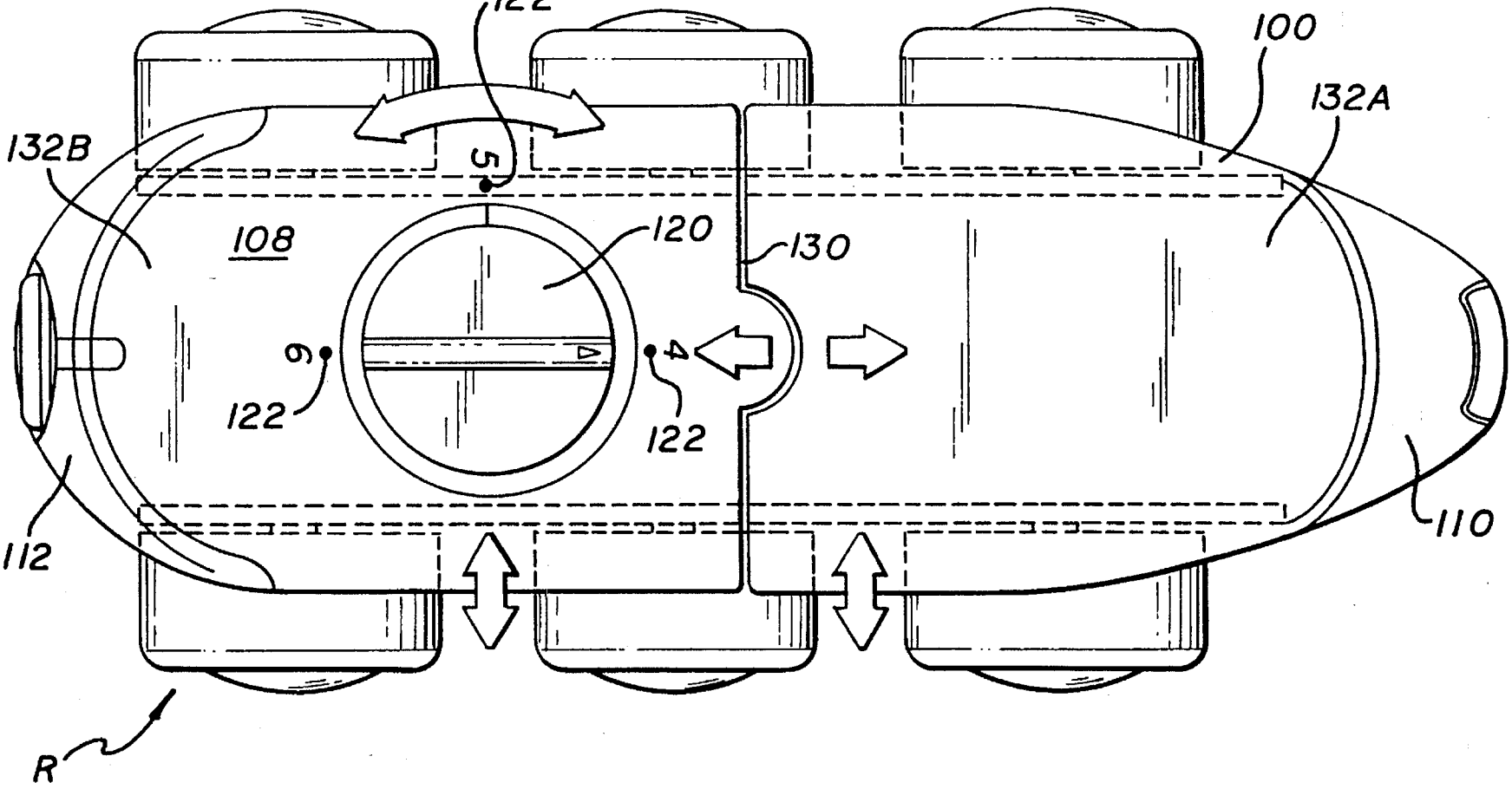
Figure 1C:
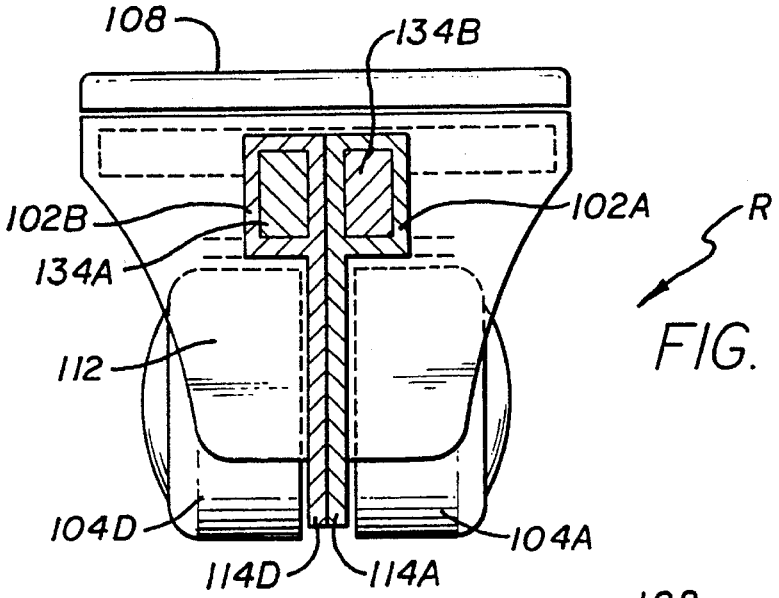
Figure 1D:
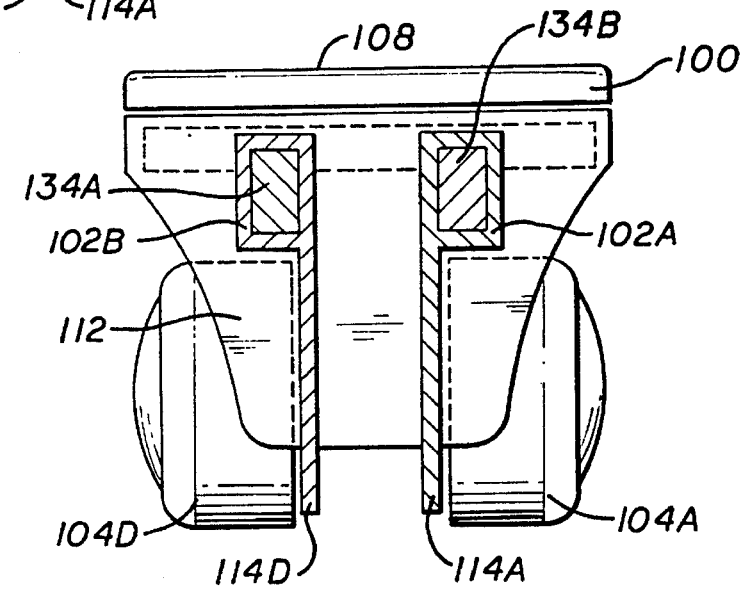
Figure 1E:
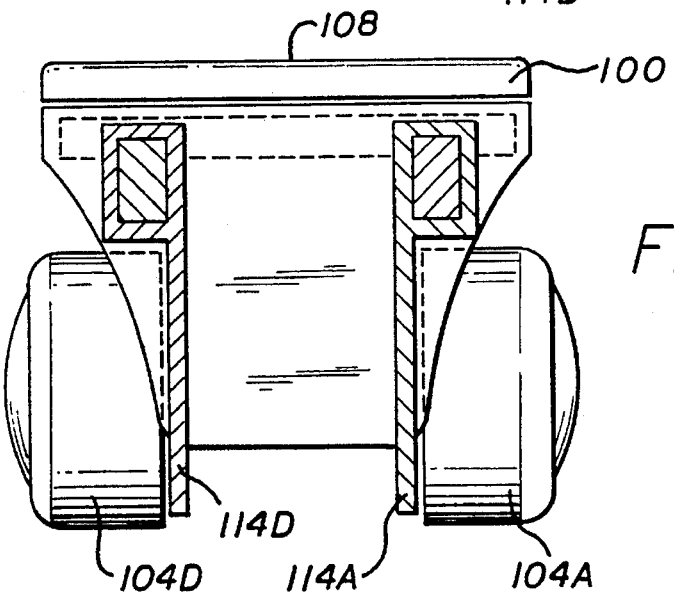

Wheel supports 102A–B and frame 100 are also suitably connected to mechanism 106 for moving wheel supports 102A–B relative to frame 100. Wheel support moving mechanism 106 allows the distance between wheel supports 102A–B to be closed or extended so that wheels 104A–F of roller skate R move closer together or farther apart. Wheel support moving mechanism 106 suitably moves each wheel individually or all of the wheels on a wheel support at the same time. Preferably, each wheel moves an identical distance as its counterpart but in the opposite direction so as to maintain the longitudinal axis of the entire wheel configuration always aligned with the centerline of the skater's foot, as shown in FIGS. 1C through 1E.

Figure 2A:
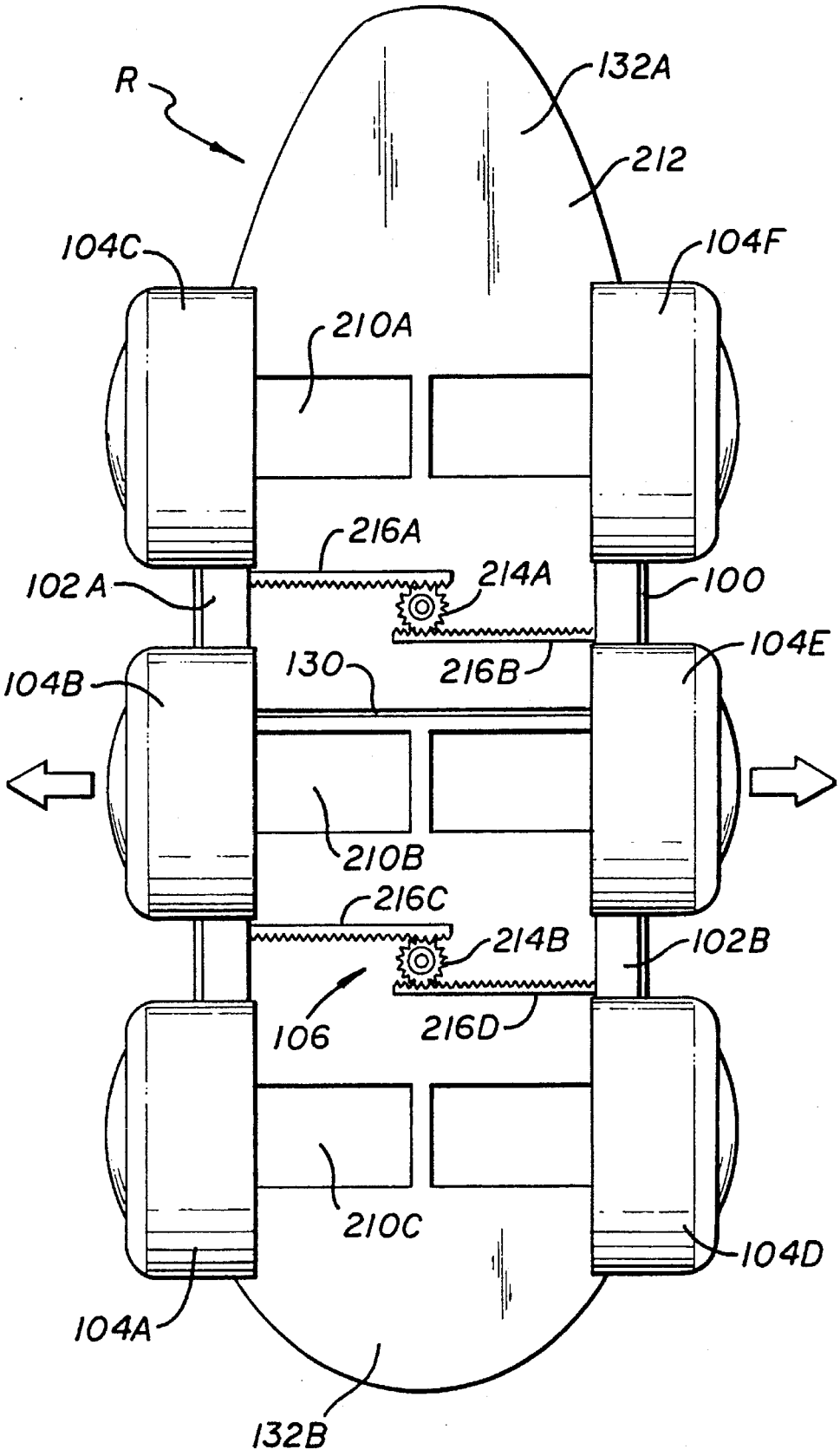
FIGS. 2A–2B illustrate bottom views of the roller skate in conventional and in-line configurations, respectively.
Figure 2B:
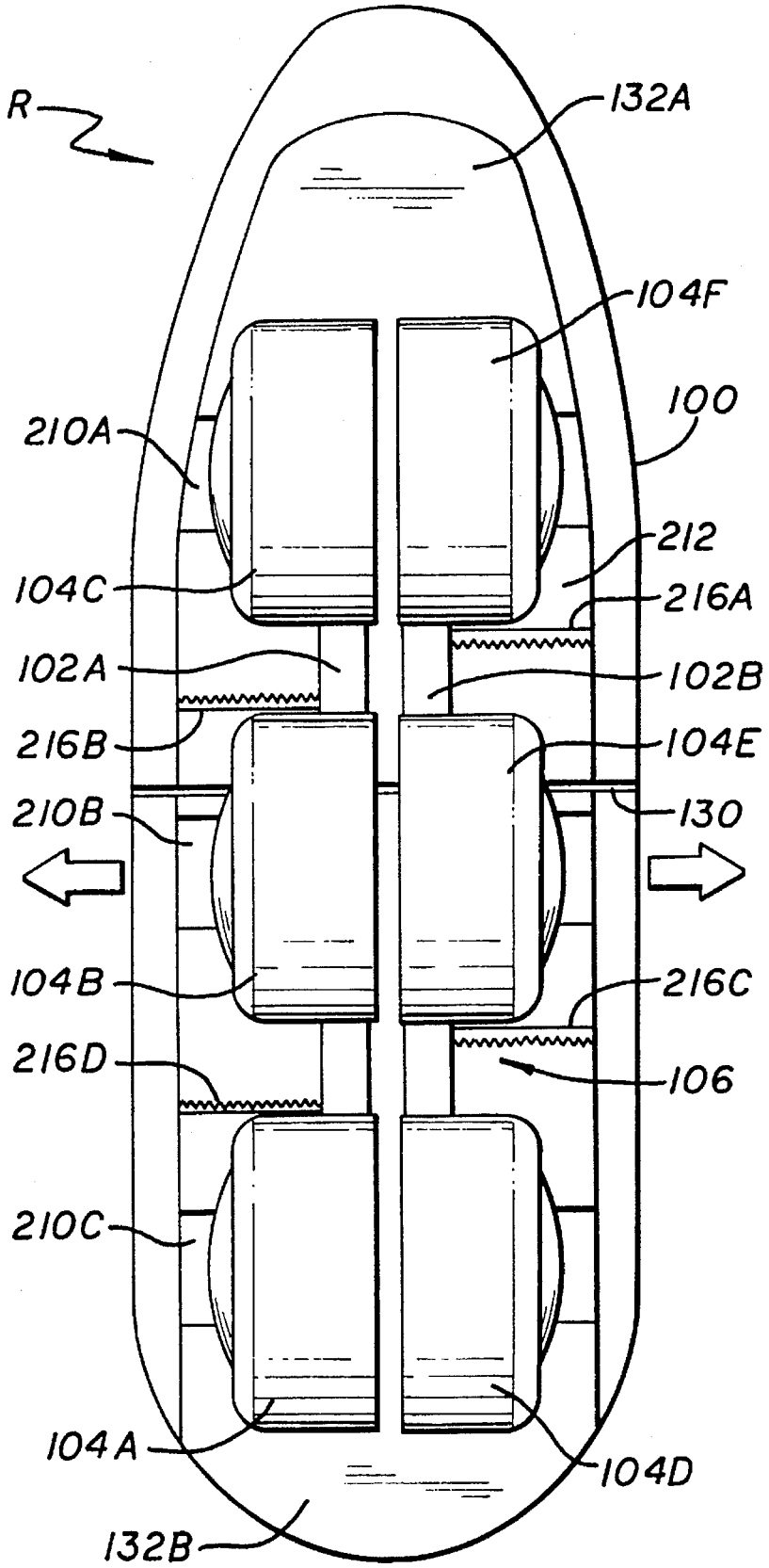
Figure 3A:
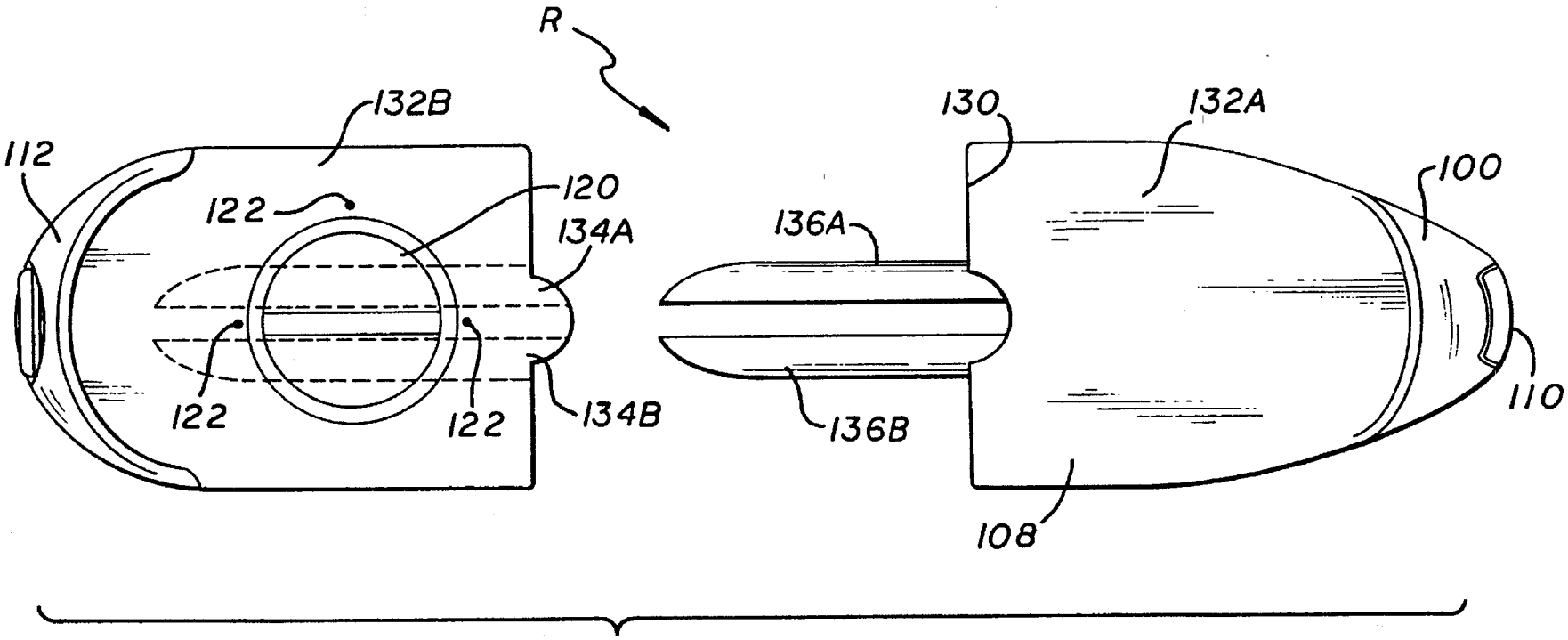
FIGS. 3A–3B illustrate top and elevational views, respectively, of the roller skate separated into front and rear sections.
Figure 3B:
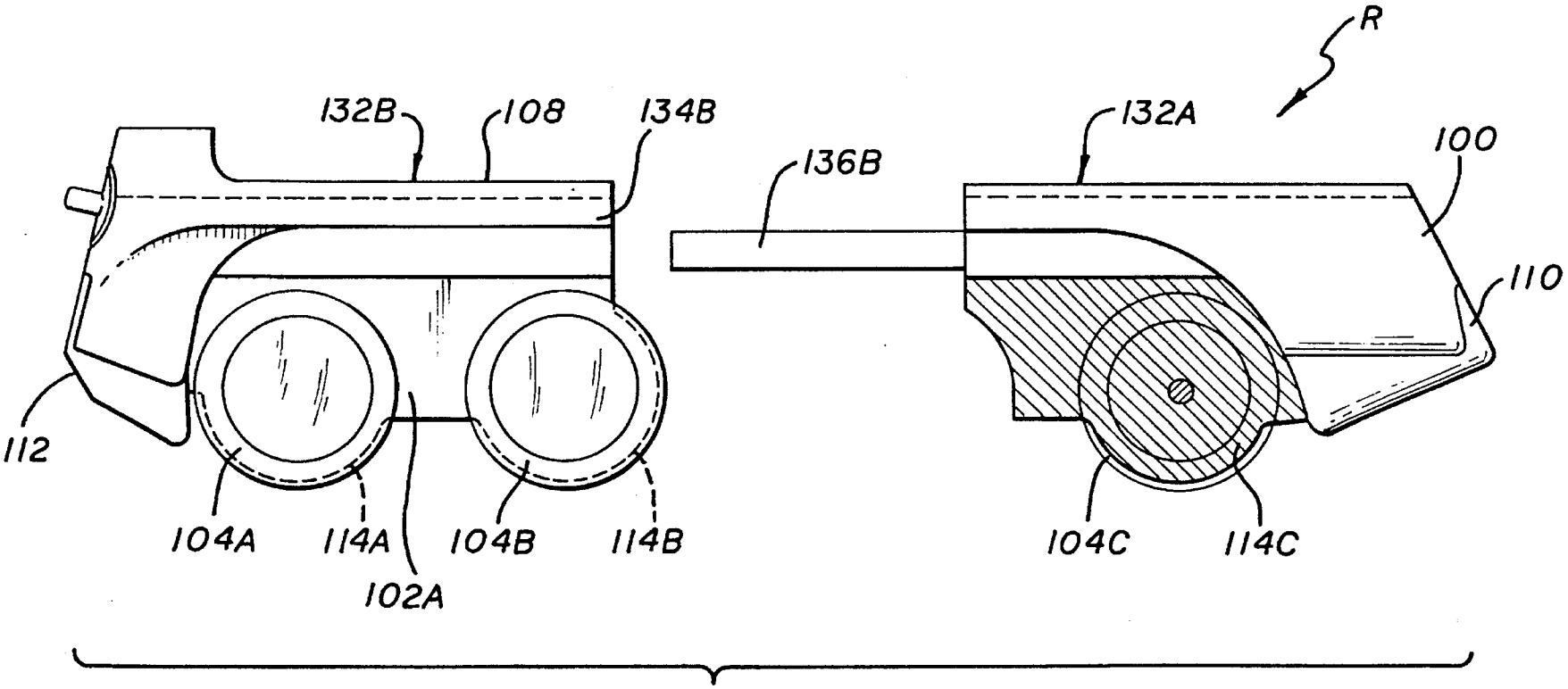

As shown in FIGS. 2A–2B, in the exemplary embodiment, wheel supports 102A–B are mounted in grooves 210A–C extending laterally across the bottom of frame 100. A rigid metal or plastic plate 212 having grooves 210A–C formed in it may be mounted in the flat area on the bottom of frame 100. Grooves 210A–C extend laterally across the bottom of frame 100, and the upper edge of wheel supports 102A–B have members which mate with grooves 210A–C to hold wheel supports 102A–B in groove 210A–C and allow wheel supports 102A–B to slide along grooves 210A–C. Grooves 210A–C maintain the longitudinal alignment of wheels 104A–F regardless of the distance between wheel supports 102A–B.

The position of wheel supports 102A–B in grooves 210A–C on the bottom of frame 100 is suitably controlled, as in the exemplary embodiment, by meshing gears 214A–B and interacting members 216A–D having teeth on the bottom of frame 100. Each wheel support suitably has two rigid metal or plastic members 216A–D equipped with teeth extending perpendicularly from wheel supports 102A–B and laterally across the bottom of frame 100 towards the opposite side of frame 100. The teeth of each member 216A–D engage the teeth of one of gears 214A–B. First gear 214A may be turned using a knob 120 suitably mounted on the upper surface of frame 100 (FIG. 1B). When knob 120 is turned, first gear 214A on the bottom of frame 100 turns as well. The interlocking teeth of gears 214A–B and wheel support members 216A–D move wheel supports 102A–B away from each other or closer together, depending upon which direction the gear is turned, at identical rates and distances. As wheel supports 102A–B move, the second set of members 216A–D rotate a second identical gear 214B, which rotates substantially freely according to the motion of members 216C–D. Consequently, the desired distance between wheel supports 102A–B may be selected by the skater simply by turning knob 120. In addition, the identical sizes of gears 214A–B and the spacing of the teeth on members 216A–D ensure that wheel supports 102A–B move the same distance away from each other and remain parallel. Knob 120 may be marked or equipped with predetermined settings 122 for particular configurations, for example, the conventional, the in-line, and an intermediate configuration.

It should be noted that this wheel moving mechanism 106 is described only as an exemplary mechanism, and many others could be incorporated instead. For example, wheel supports having locking positions in the grooves may be provided so that wheels 104A–F lock in particular positions as they are moved laterally across grooves 210A–C on the bottom of frame 100. A compression spring may be mounted between wheels 104A–F or wheel supports 102A–B to bias wheels 104A–F away from each other. Many other mechanisms may be used for moving wheel supports 102A–B closer together or farther apart according to the skater's desires.

Initially, a beginner skater may wish to have wheel supports 102A–B set as far apart as possible, as shown in FIG. 2A, so that wheels 104A–F are in their most stable position on the outermost edges of skate R. As the skater improves and becomes more confident, the skater may move wheels 104A–F to an intermediate position, for example, midway between wheels 104A–F outermost position and their innermost position. Ultimately, as the skater progresses, the distance between wheel supports 102A–B may be eliminated so that wheel supports 102A–B nearly meet, placing each wheel close to its counterpart (FIG. 2B). In this configuration, skate R is effectively an in-line roller skate. For accomplished skaters, the different wheel positions can be used to accommodate differing skating conditions or otherwise to accommodate the skater's preferences for skating configurations at any given time.

In the preferred exemplary embodiment, roller skate R may also be adjustable to fit several different foot sizes of skaters. The length of skate R may be altered to fit the length of the skater's foot. In particular, frame 100 and wheel supports 102A–B are suitably separated approximately at the midpoint 130 into two sections, suitably comprising a front section 132A and a rear section 132B. Rear sections 132B of each wheel support 102A–B suitably include two rear wheels 104A–B and 104D–E, and front sections 132A suitably include only front wheels 104C and 104F. Rear section 132B of each wheel support 102A–B includes a square conduit 134A–B suitably formed into the material of each wheel support 102A–B along the upper edge of wheel support 102A–B near frame 100. Each conduit 134A–B extends parallel to the longitudinal axis of skate R and has a hollow interior.

Front section 132A of each wheel support 102A–B, on the other hand, includes a square rod 136A–B suitably formed into the material of each wheel support 102A–B along the upper edge of each wheel support 102A–B near frame 100. Each rod 136A–B suitably projects several inches rearward from front section 132A parallel to the longitudinal axis of skate R. The cross-section of each rod 136A–B has slightly less area than the cross-section of conduit 136A–B interior, so that rods 136A–B may slide into conduits 134A–B, thus allowing the length of skate R to be adjusted according to the length of the skater's foot. The rigidity of conduits 134A–B and rods 136A–B, however, prevents relative movement or rotation of front and rear sections 132A and 132B respectively in directions other than along skate R's longitudinal axis.

Figure 4A:
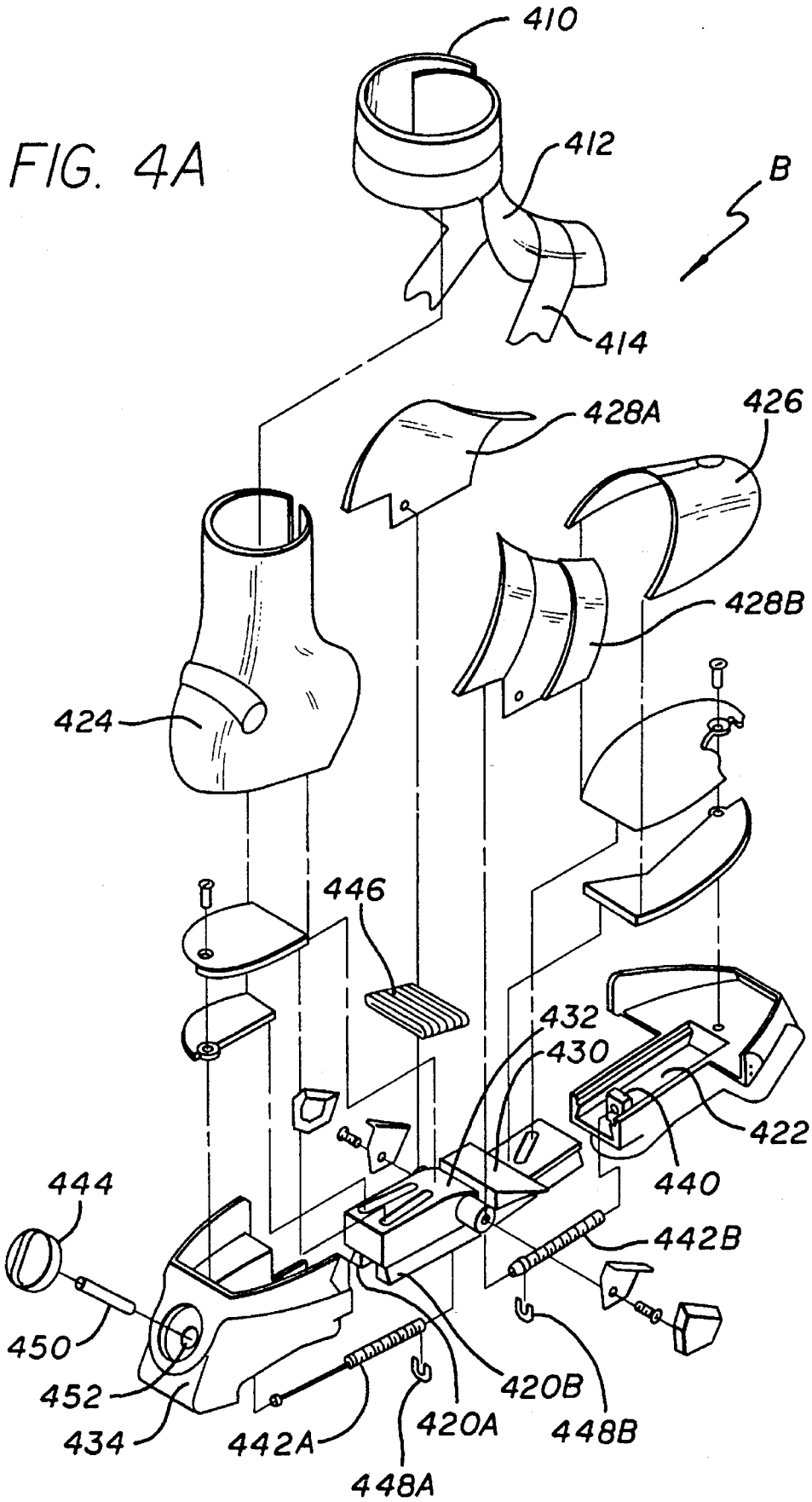
FIGS. 4A–4E illustrate an exploded view of the boot, cutaway top and cutaway elevational views of the boot and bottom portion extended, and cutaway top and elevational views of the boot and bottom portion without extension, respectively.
Figure 4B:
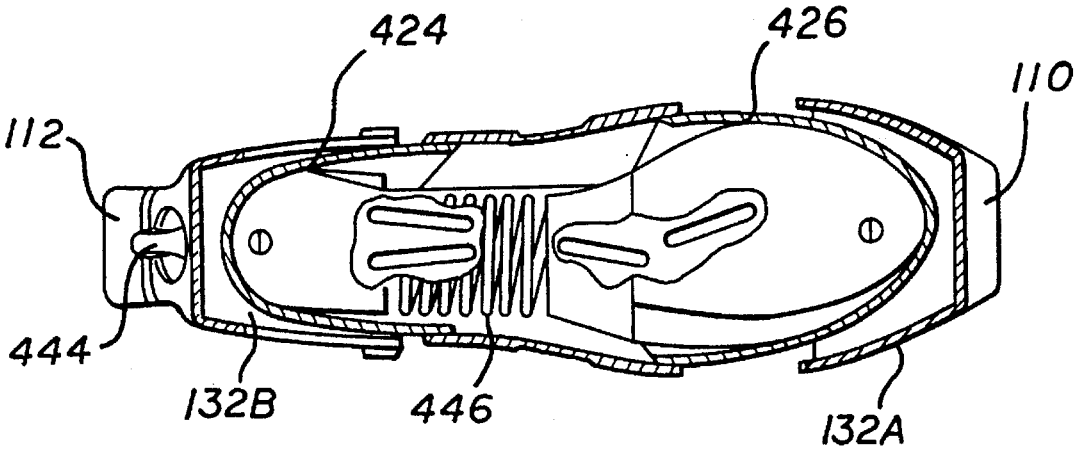
Figure 4C:
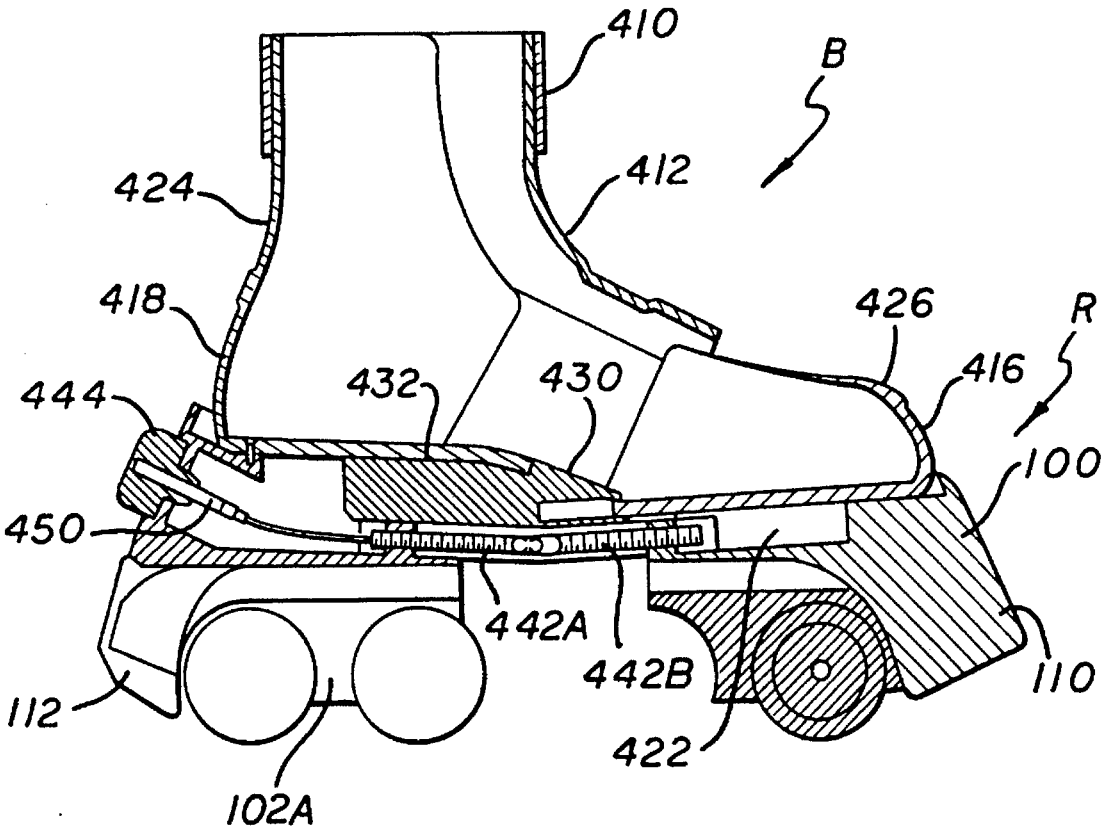
Figure 4D:
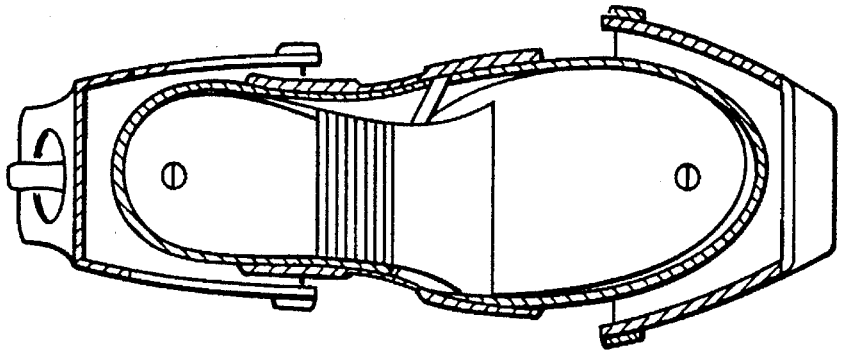
Figure 4E:
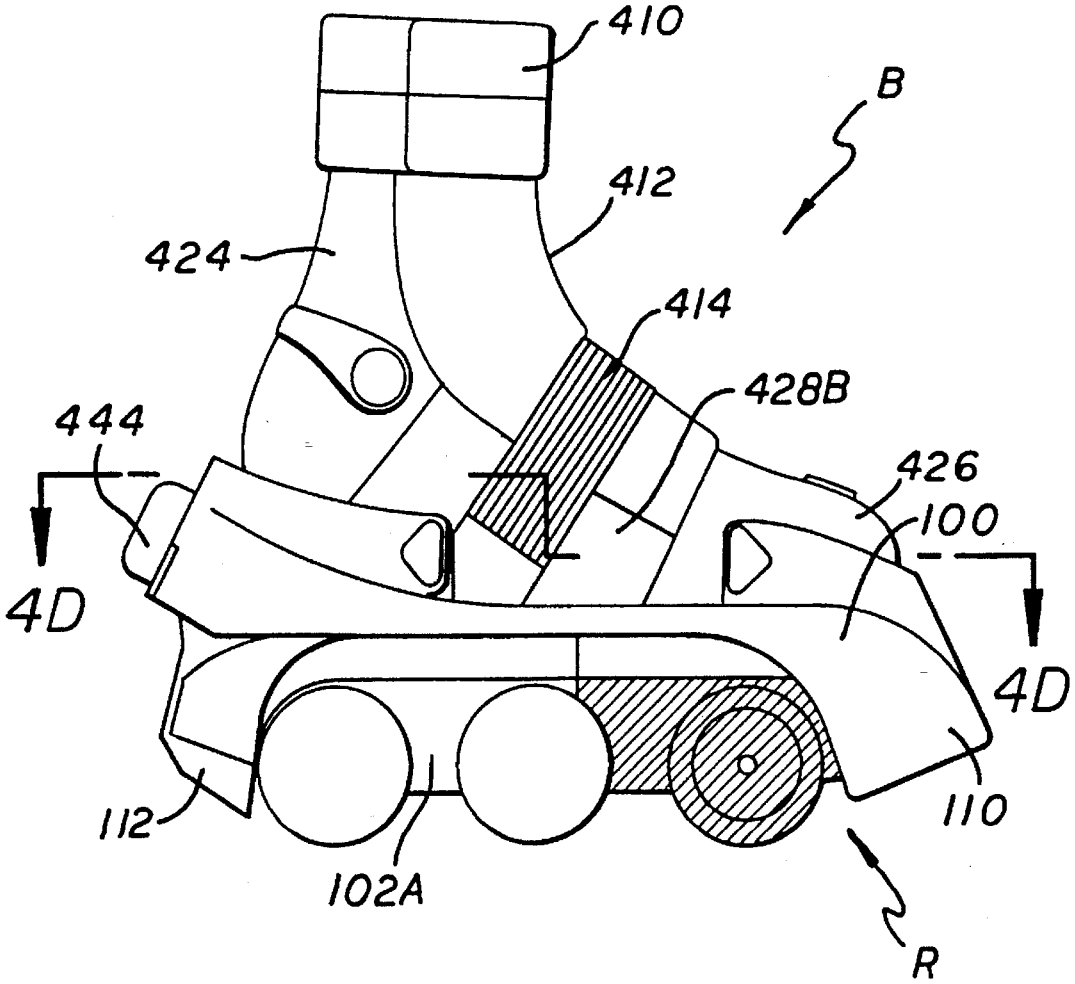

Referring now to FIG. 4A–C, a suitable mechanism for coupling the roller skate R to the skater's foot or shoe may be mounted on the upper surface of frame 100. This mechanism may be a type of shoe or boot permanently fixed to frame 100 which fits over the skater's foot, or may be a mechanism that removably couples skate R to the skater's conventional shoe or boot, like a system of brackets and straps. In the exemplary embodiment, the foot coupling mechanism is suitably a simulated boot B permanently fixed to the upper surface of frame 100 which may fit over the skater's foot. Boot B is composed of a suitable durable and flexible material, such as plastic or various kinds of modern fabric material, and is suitably sized. Boot B may be equipped with an expandable cuff 410 and tongue 412 at its top to widen the opening and allow the skater's foot to enter boot B. A strap 414 may then be tightened over the skater's foot and boot B to secure skate R to the skater's foot.

Boot B is suitably extendable, like frame 100 and wheel supports 102A–B, to conform to the length of the skater's foot. Like frame 100 and wheel supports 102A–B, boot B may be divided into two sections. A toe 416 of boot B is suitably mounted on front section 132A of frame 100, and a heel 418 of boot B is suitably mounted on rear section 132B of frame 100. Boot heel 418 suitably includes a pair of skids 420A–B projecting forward from boot heel 418, which are suitably inserted into a groove 422 formed in the base of boot toe 416. Skids 420A–B and groove 422 suitably extend along the longitudinal axis of boot B beneath a surface on which the skater's foot rests. Skids 420A–B and groove 422 are suitably shaped so that movement of skids 420A–B, other than longitudinally along groove 422, is inhibited. For example, in the exemplary embodiment, the bottom portion of skid 420A–B is larger than the top portion of groove 422, preventing skid 420A–B from moving up and out of groove 422.

The top portion of boot B suitably includes a boot heel cover 424, a boot toe cover 426, and a pair of side covers 428A–B, which permit the length of skate R to be extended. Boot heel 418 is suitably slightly raised by a ramp 430, a block 432, and boot heel support 434 for the comfort of the skater. Block 432 and ramp 430 are positioned over skids 420A–B. Boot heel cover 424 and boot toe cover 426 are suitably shaped so that they mate when boot B is collapsed to its shortest length. Side covers 428A–B are suitably attached to the top of block 432, and overlap boot heel cover 424, including tongue 412, and boot toe cover 426 of boot B. When boot B is extended to fit a larger foot, toe section 426 of boot B no longer mates with heel section 424, but side covers 428A–B conceal the gap between heel cover 424 and toe cover 426. This provides continuous coverage of the skater's foot by boot B.

In accordance with the exemplary embodiment as shown in the drawings, the arrangement for accommodating the skater's foot looks very much like a boot, but is not a boot in the sense that it is adjustable. This is an advantage, particularly for young skaters, in the sense that they have a skate which "looks like" a boot skate, but has adjustability features to accommodate their growing feet.

A roller skate according to the present invention having an adjustable length may include a mechanism for extending or reducing the length of the skate to fit a particular user and for holding the skate at the selected size. In the present exemplary embodiment, an extending mechanism suitably comprises a nut 440, a bolt 442A–B, a knob 444, and a spring 446. Nut 440 is suitably permanently mounted in groove 210A–C of boot toe 416 between skids 420A–B. Nut 440 has a threaded hole formed in it. Bolt 442A–B suitably has a similarly threaded outer surface, and is suitably sized to fit through the hole in nut 440 and engage the threads. Like nut 440, bolt 442A–B is suitably positioned between skids 420A–B and may be confined to the area between skids 420A–B by a pair of brackets 448A–B.

At boot heel 418, knob 444 is suitably attached so that extension knob 444 may be rotated by the skater. Extension knob 444 has a shaft 450 which extends through a hole 452 formed in the boot heel support. Shaft 450 is suitably connected to bolt 442A–B by a universal joint (not shown) so that rotation of extension knob 444 causes bolt 442A–B to rotate as well. As bolt 442A–B rotates, the threads of bolt 442A–B and nut 440 engage and force nut 440 to travel along the length of bolt 442A–B. Because nut 440 is fixed to boot toe 416 and extension knob 444 and bolt 442A–B are connected to boot heel 418, the distance between boot heel 418 and boot toe 416 varies accordingly, thus changing the length of skate R.

To bias boot toe 416 toward boot heel 418, spring 446 is connected between boot toe 416 and boot heel 418. In the exemplary embodiment, spring 446 is a flat expansion spring. As the length of skate R increases, the tension on spring 446 increases, biasing boot toe 416 and boot heel 418 towards each other. This bias helps to hold skate R at its current length by increasing the friction between bolt 442A–B and nut 440, thus preventing inadvertent rotation of bolt 442A–B.

A roller skate according to the present invention, as described above, permits a skater to learn both conventional and in-line skating with a single pair of skates. As a beginner, the skater may begin with wheels 104A–F in the conventional configuration for mastering the fundamental skills. As the skater improves, wheel supports 102A–B may be moved closer together to simulate an in-line skate. In addition, skate R may be adjusted to larger sizes as the skater grows by simply twisting the extension knob until the desired length is achieved. In accordance with one embodiment of the invention, skate R is provided with a "boot look" foot or shoe enclosing upper which also adjusts while maintaining a "boot look" appearance. Finally, when the skater is ready, the distance between wheel supports 102A–B may be eliminated, so that skate R becomes an in-line skate. On the other hand, even for experienced skaters, if the skater prefers conventional skates, skate R may simply be readjusted to the conventional configuration. Also, experienced skaters can use the integral multi-function aspect of the integral skate system of the present invention to provide enhanced skate stability when difficult skating conditions are encountered.

The foregoing description of the exemplary embodiment is for illustrative purposes only and should not be construed to limit the invention to the embodiment described above. It would be apparent to one of ordinary skill in the field that several changes in the components, materials, construction, design, and arrangement of the above roller skate may be made without departing from the spirit of the invention. For example, different adjustment mechanisms other than as specifically disclosed herein can be used to position the skate wheels to achieve the multi-functionality of the present invention. Also, different size adjustment mechanisms other than as disclosed herein to accommodate varying foot sizes can be used. Moreover, a skate with the multi-function features of the present invention can be used without any size adjustment features, with the skate made in different sizes to accommodate different sizes of feet.

We claim:

1. A multi-function roller skate system, comprising:

a frame having a longitudinal axis along a line of intended travel and having a perpendicular lateral axis;

a plurality of roller skate wheels longitudinally aligned such that they are parallel to the longitudinal axis of the frame;

at least an additional two roller skate wheels and at least one wheel support for supporting said additional roller skate wheels laterally opposing one another at a first location along the longitudinal axis of the roller skate;

said at least one wheel support including adjustment means for adjusting the lateral spacing between said additional two roller skate wheels between a first position in which the two wheels are laterally spaced apart a first predetermined distance and a second position in which the two wheels are adjacent one another centered along the longitudinal axis to cooperatively function as an in-line roller skate wheel.

2. The roller skate system of claim 1, wherein said wheel support adjustment means further is adapted to adjust said two roller skate wheels to a third position in which said wheels are laterally spaced apart a second predetermined distance different from the first predetermined distance.

3. The roller skate system of claim 1, wherein said adjustment means simultaneously moves said two wheels between the first and second positions.

4. The roller skate system of claim 1, wherein said roller skate further comprises means for adjusting the length of said roller skate frame for accommodating differing foot sizes.

5. The roller skate system of claim 1 including an additional wheel support for supporting a further additional two roller skate wheels laterally opposing one another at a second location along the longitudinal axis of the roller skate;

said additional wheel support including adjustment means for adjusting the lateral spacing between said further additional two roller skate wheels between a first position in which the further additional two wheels are laterally spaced apart a first predetermined distance and a second position in which the further additional two wheels are adjacent one another centered along the longitudinal axis to cooperatively function as an in-line roller skate wheel.

6. The roller skate system of claim 5 wherein said adjustment means of said additional wheel support simultaneously moves said further additional two wheels between the first and second positions.

7. The roller skate system of claim 6 in which said adjustment means of said additional wheel support simultaneously moves both said additional two wheels and said further additional two wheels between the first and second positions.

8. The roller skate system of claim 7, wherein said roller skate further comprises means for adjusting the length of said roller skate frame for accommodating differing foot sizes.

9. A multi-function roller skate system, comprising:

a frame having a longitudinal axis along a line of intended travel and having a perpendicular lateral axis;

a plurality of roller skate wheels mounted to the frame for rotation along the line of intended travel;

at least one wheel support for supporting at least two of said plurality of roller skate wheels laterally opposing one another at a first location along the longitudinal axis of the roller skate;

said at least one wheel support including adjustment means for adjusting the lateral spacing between said two roller skate wheels between a first position in which the two wheels are laterally spaced apart a first predetermined distance and a second position in which the two wheels are adjacent one another centered along the longitudinal axis to cooperatively function as an in-line roller skate wheel.

* * * * *